US005659222A

United States Patent [19]

Ragsdale et al.

[11] Patent Number: 5,659,222

[45] Date of Patent: Aug. 19, 1997

[54] VACUUM SEALED INCANDESCENT LAMP WITH IMPROVED FILAMENT SUPPORT STRUCTURE

[75] Inventors: Charles R. Ragsdale, Newport Beach; John B. Hartley, Pacific Palisades, both of Calif.

[73] Assignee: Illumination Technology, Inc., Cypress, Calif.

[21] Appl. No.: 607,724

[22] Filed: Feb. 27, 1996

[51] Int. Cl.[6] ..... H01K 1/22; H01K 1/38

[52] U.S. Cl. ..... 313/578; 313/623; 313/275; 313/279; 313/315; 313/331

[58] Field of Search ..... 313/578, 623, 313/625, 626, 634, 271, 278, 279, 331, 332, 334, 275, 318.08, 318.01, 315; 439/230, 602, 605; 362/382, 441, 806

[56] References Cited

U.S. PATENT DOCUMENTS

| | | | |
|---|---|---|---|
| 3,413,054 | 11/1968 | Richards et al. | 313/578 X |
| 3,465,197 | 9/1969 | Martin | 313/315 X |
| 4,254,300 | 3/1981 | Thompson-Russell | 313/331 X |
| 4,587,454 | 5/1986 | Bonazoli et al. | 313/331 |
| 4,644,220 | 2/1987 | Carley | 313/315 X |
| 4,893,050 | 1/1990 | Fields | 313/578 X |
| 5,270,609 | 12/1993 | Smith et al. | 313/271 |
| 5,508,587 | 4/1996 | Williams et al. | 313/578 |

FOREIGN PATENT DOCUMENTS

| | | | |
|---|---|---|---|
| 1185719 | 1/1965 | Germany | 313/315 |

*Primary Examiner*—Ashok Patel

*Attorney, Agent, or Firm*—Klein & Szekeres, LLP

[57] ABSTRACT

A subminiature incandescent lamp has a substantially cylindrical base to which a glass envelope enclosing the interior of the lamp is sealed. A pair of contact wires or pins are made of a metal alloy that has substantially the same thermal expansion coefficient as the glass base. The contact pins are embedded and sealed to the glass base in a gas-tight manner, with a glass-to-metal seal. The contact pins extend below the base to provide external connections of the lamp to a power source. The pins also extend into the interior of the lamp, and provide electrical contact to a filament which is mounted between them. A filament support wire is anchored in the glass base at one end thereof and has a loop at its other end in which the mid-section of the filament rests and is mechanically supported.

20 Claims, 2 Drawing Sheets

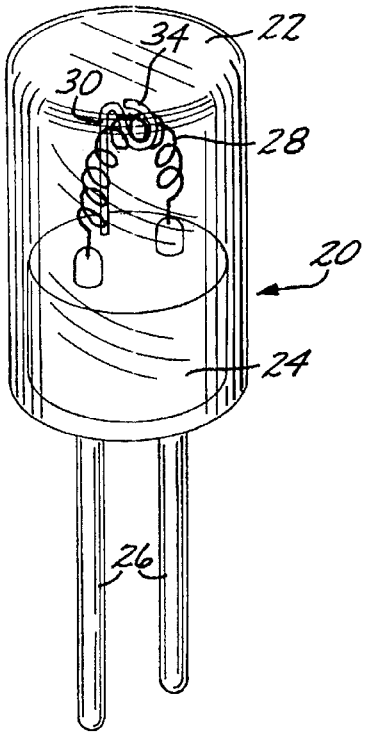
FIG. 1
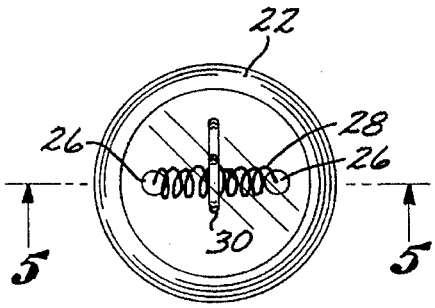
FIG. 2
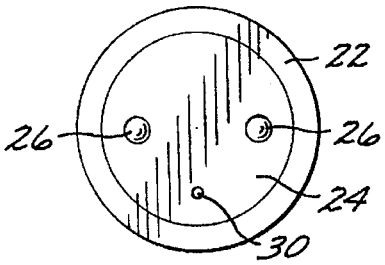
FIG. 3
FIG. 4
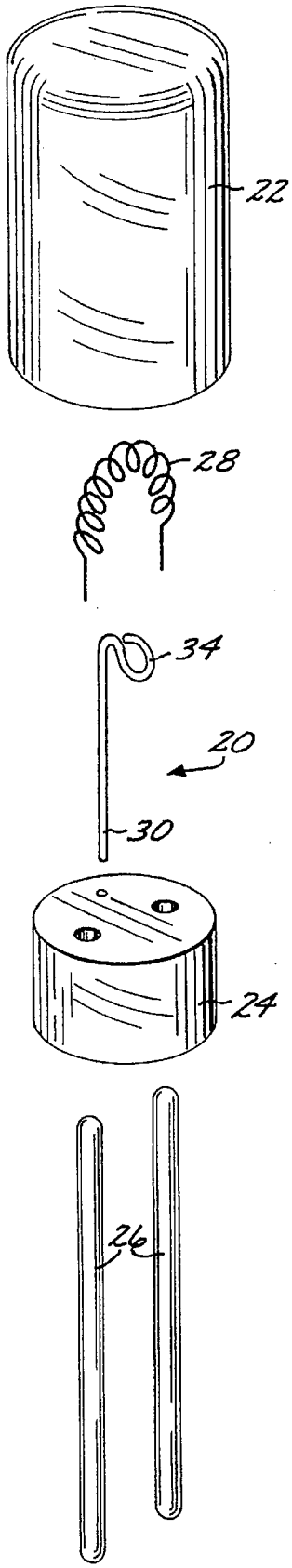

VACUUM SEALED INCANDESCENT LAMP WITH IMPROVED FILAMENT SUPPORT STRUCTURE

BACKGROUND OF THE INVENTION

1. Field of the Invention

The present invention is directed to a vacuum sealed subminiature incandescent lamp, and more particularly to a sub-miniature incandescent lamp having an improved filament support wire subassembly.

2. Brief Description of the Prior Art

Subminiature incandescent lamps are well known in the art. Generally speaking such lamps have a diameter of less than approximately 0.5 inch and are frequently used in instrument panels, automotive dash boards and the like. Still further, such lamps are typically designed to work with a power source of approximately 3 to 18 Volts. As is well known in the art, many state-of-the-art lamps include a support wire subassembly the function of which is to mechanically support the incandescent filament, usually in the mid-point between the places of attachment of the filament to the wires or posts which provide electrical contacts to the filament. The support wire subassembly however, generally speaking, does not provide electrical contact or contacts to the filament. As in all incandescent lamps, the interior of the lamp having the support wire subassembly must be sealed from the environment in a gas-tight or vacuum-tight manner. Because hermetically sealing lamps at places where wires or like metal parts extend from the interior of the lamp to the outside has always been a problem in the art (with the art striving to need as few such seals as possible) support wire subassemblies for incandescent lamps are usually kept entirely within the interior of the lamp. One typical state-of-the-art technique to manufacture such lamps is to place a molten glass bead on the base of the electrical contact posts in the interior of the lamp before the lamp is sealed. A molybdenium support wire for the filament is then placed into this glass bead while the bead is still soft enough to embed the wire. After the lamp's envelope is sealed the entire support subassembly is within the interior of the lamp. However, the just described process is expensive because of the extra manufacturing steps involved. Moreover, the entire support wire subassembly including the glass bead is mechanically supported only by the two electric contact wires or posts of the lamp. Therefore, a need exists in the art for a subminiature incandescent lamp with an improved support wire subassembly which is relatively less cumbersome to manufacture. The present invention satisfies this need.

SUMMARY OF THE INVENTION

It is an object of the present invention to provide a subminiature incandescent lamp having an improved filament support wire subassembly.

It is another object of the present invention to provide a subminiature incandescent lamp wherein the filament support wire subassembly is solidly anchored in the base of the lamp.

It is still another object of the present invention to provide a subminiature incandescent lamp having a filament support wire subassembly which is relatively inexpensive to manufacture.

It is yet another object of the present invention to provide a subminiature incandescent lamp which has only efficient glass-to-metal seals.

The foregoing objects and advantages are attained by a subminiature incandescent lamp having a glass bead base in which two contact wires or pins and a filament support wire are embedded and hermetically sealed. The contact wires or pins protrude from the base and provide external electrical connection to the lamp. The support wire terminates substantially flush with the bottom of the base. The wires are made of electrically conductive metal alloy that has a thermal extension coefficient substantially matching that of glass; preferably the wires are made of a copper sheathed nickel iron alloy known in the trade as DUMET. The two contact wires support and provide electrical connection to a tungsten filament which is mounted in between them. Further mechanical support to the filament is provided by the support wire. A glass envelope is hermetically sealed to the glass bead base, thereby enclosing the filament. In alternative embodiments the support wire is mounted into the glass bead base, but the hole for the support wire does not penetrate entirely through the base so that the support wire terminates in the interior of the base and hermetical sealing of a hole for the support wire is not necessary. In the alternative embodiments the support wire may comprise molybdenum alloy or other suitable alloys known in the art.

The features of the present invention can be best understood together with further objects and advantages by reference to the following description, taken in connection with the accompanying drawings, wherein like numerals indicate like parts.

BRIEF DESCRIPTION OF THE DRAWINGS

FIG. 1 is a perspective view of a first preferred embodiment of the subminiature incandescent lamp of the present invention;

FIG. 2 is a top view of the first preferred embodiment;

FIG. 3 is a bottom view of the first preferred embodiment;

FIG. 4 is an exploded perspective view of the first preferred embodiment;

DESCRIPTION OF THE PREFERRED EMBODIMENTS

Figure 5:
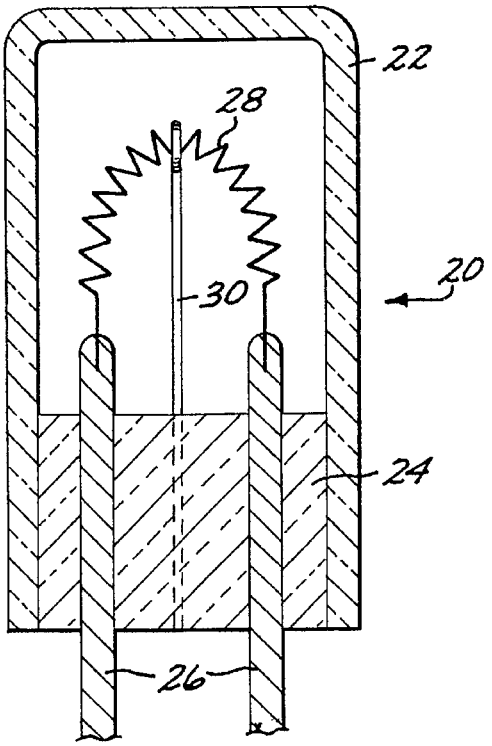
FIG. 5 is a cross-sectional view of the first preferred embodiment, the cross-section being taken on lines 5,5 of FIG. 2.
Figure 6:
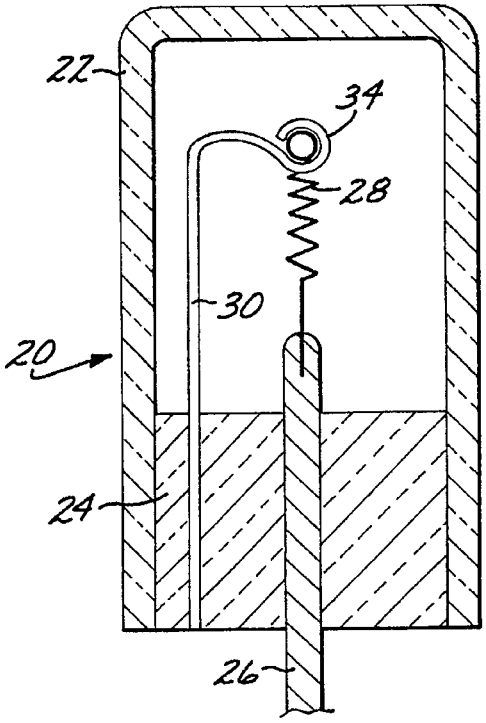
FIG. 6 is another cross-sectional view of the first preferred embodiment.

The following specification taken in conjunction with the drawings sets forth the preferred embodiments of the present invention. The embodiments of the invention disclosed herein are the best modes contemplated by the inventors for carrying out their invention in a commercial environment, although it should be understood that various modifications can be accomplished within the parameters of the present invention.

Referring now to FIGS. 1–6, and particularly to the exploded perspective view of FIG. 4 of the appended drawings, a first preferred embodiment 20 of the incandescent lamp or light bulb of the present invention is disclosed. As it is noted briefly in the introductory sections of the present application for patent, the incandescent lamp or light bulb of the present invention is of "subminiature" size. As this term is generally understood in the trade, a subminiature light bulb has a diameter which, generally speaking, does not exceed approximately 0.5 inch. Still generally speaking, subminiature light bulbs are used in instrument panels, automotive, aviation and military equipment dash boards and like applications. They are usually powered by a power source of approximately 3 to 18 Volts, more typically of approximately 12 to 16 Volts. However, it should be understood that incandescent lamps or light bulbs can be constructed in accordance with the present invention which operate on higher or lower voltage.

As it is shown by the drawing figures, the first embodiment 20 includes a substantially cylindrical transparent glass envelope 22. Suitable materials for the glass envelope 22 include soda lime, soda lead and borosilicate glass. The glass envelope 22 of the presently preferred embodiment comprises clear Schott AR Glass (8350) which is commercially available.

The light bulb 20 of the invention further comprises a glass bead base 24 of substantially cylindrical configuration. The glass bead base 24 may be made of the same glass material as the envelope. In the herein described preferred embodiment however, the base 24 is BLUE SCHOTT GLASS 8350. As it will be readily understood by those skilled in the art, glass is either colloidically or ionically made to be colored, or can be dyed, however in the instant application the color (or lack of it) of the glass bead base 24 is substantially unimportant. Examples of other commercially available glasses from which a non-transparent bead base can be made are CORNING 0080, and KIMBLE R-6.

A pair of contact wires or pins 26 are mounted and hermetically sealed into the glass bead base 24 with glass-to-metal seal. As the drawings, and particularly FIGS. 1 and 5–6 indicate, the two pins 26 are substantially axially aligned with the glass bead base 24, are disposed parallel with each other, and extend substantially below the base 24. Within the interior of the light bulb 20 an incandescent filament 28 is mounted to the pins 26. The pins 26 are made from a metal composition which has substantially the same thermal extension coefficient as the glass bead 24 into which the pin 26 is embedded and sealed. A metal composition highly suitable for this purpose is an alloy known under the trade name DUMET®; this is an alloy having a nickel-iron core and a copper sheath. A principal characteristic of this alloy is that it has substantially the same coefficient of thermal expansion as glass, so that it can be sealed hermetically into glass with a glass-to-metal seal. The material of the filament 28 is substantially harder than the copper sheath of the pins 26 so that the filament 28 is attached to the pins 26 by impacting or pushing the ends of the filament 28 into the respective pins 26. This technique per se is not novel, and is known in the art as "staking". The filament 28 itself is of conventional construction. The precise nature of the material of the filament 28 is also not critical, for as long as it is reasonably within the range of materials used in the art for incandescent light bulb filaments. In the herein described preferred embodiments the filament 28 is made of tungsten alloyed with approximately 3% rhenium. The portion or part of the pins 26 which protrude below the glass bead base 24 are used to connect the incandescent lamp 20 to a power source (not shown) in a conventional manner, for example by soldering.

Referring still to FIGS. 1–6 of the appended drawings, a principal novel feature of the first embodiment 20 of the incandescent lamp of the present invention is that a filament support wire 30 is also embedded and is hermetically sealed with a glass-to-metal seal within a circular, axially aligned hole or aperture 32 in the glass bead base 24. The filament support wire 30 is also made of a metal alloy which has substantially the same thermal expansion coefficient as the glass bead base 24. In the herein described first preferred embodiment 20 the filament support wire 30, like the pins 26, is made of DUMET® alloy. Unlike the pins 26, however, the filament support wire 30 does not need to protrude substantially from the bottom of the glass bead base 24. Preferably in this embodiment the end of the support wire 30 is substantially flush with the bottom of the base 24. The other end of the filament support wire 30 comprises a loop or hook 34 into which the mid-section of the incandescent filament 28 is placed and wherein the filament 28 is mechanically supported.

The glass envelope 22 is hermetically sealed in a heat sealing process to the glass bead base 24. As is customary in art, during the heat sealing process the interior of the lamp 20 is evacuated so that the functioning lamp has near perfect vacuum inside. The integrity of this vacuum is maintained in accordance with the invention, because reliable, substantially cylindrical glass-to-metal seals are formed between the glass base 24, the pins 26 and also between the base 24 and the portion of the filament support wire 30 which is embedded in the base 24.

Although precise dimensions of the subminiature lamp assembly of the present invention and dimensions of its several parts are not critical, by way description of the first preferred embodiment 20 the following exemplary dimensions are noted. Diameter of the glass envelope 22 and therefore of the lamp 20 is 0.21875" (inch); wall thickness of the envelope is 0.0225"; length of the envelope is 0.400", the diameter of the glass bead base 24 is 0.168" and its height or length is 0.135". The contact pins 26 are of 0.020" diameter DUMET® wire, their overall length is 0.500" and they extend 0.035" from the bottom of the base 24. The filament support wire 30 is of 0.008" diameter DUMET® wire, this wire 30 rises approximately 0.185" into the interior of the lamp 20 where it comes into contact with the filament 28. The filament is of 10–11μ (micron) diameter tungsten rhenium wire, is 2.25" long before winding, 0.220" long after winding and contains 80 turns.

The herein described subminiature lamp assembly 20 is preferably manufactured in accordance with the following steps. First, the DUMET® alloy contact wires or pins 26 and the DUMET® alloy filament support wire 30 are placed into preexisting holes or apertures in the glass bead base 24. These wires are then sealed to the glass bead 24 in a sealing process performed in a vacuum furnace (not shown). The sealing process itself is well known in the art and need not be described here in detail. It should be noted however, that this process provides a hermetic, gas and vacuum-tight seal between the DUMET® alloy wires and the glass bead 24. Thereafter, the filament 28 is attached, as noted above, by "staking" to the pins 26. The loop 34 is then formed at the end of the support wire 30 to wrap around the filament 28. The glass envelope 22 is thereafter placed and sealed to the glass bead 24 in a vacuum furnace (not shown) in a sealing process where the interior of the lamp 20 is evacuated.

Figure 7:
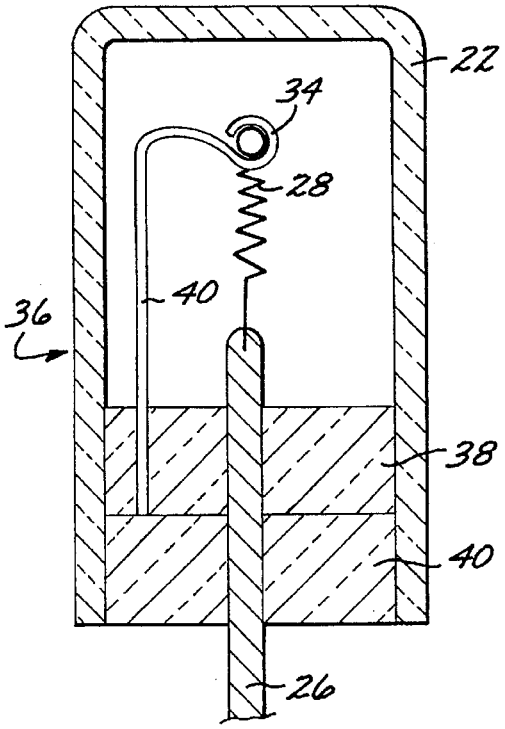
FIG. 7 is a cross-sectional view of a second preferred embodiment of the subminiature incandescent lamp of the present invention.

FIG. 7 of the appended drawings discloses a second preferred embodiment 36 of the subminiature incandescent lamp of the present invention. This embodiment is described here only to the extent it is different from the first preferred embodiment 20. Thus, in this embodiment 36, the base of the lamp comprises a first glass bead 38 that embeds the two DUMET® alloy contact wires or pins 26. Only one such pin 26 is visible in the cross-sectional view of FIG. 7. The contact pins 26 extend from the first glass bead 38 upwardly into the interior of the lamp 36. The first glass bead 38 also embeds a filament support wire 40 which is mounted in an aperture that, like the apertures accommodating the pins 26, extends axially through the entire length or height of the first glass bead 38. A second glass bead 42 is disposed below the first glass bead 38, and forms the bottom of the incandescent lamp 36. The filament support wire 40 does not extend into the second glass bead 42. The pins 26 however penetrate through it and extend below, to provide electrical connections for the lamp 36. During the manufacturing process the two glass beads 38 and 42 are stacked, the apertures for the pins 26 in the two beads are aligned and the pins 26 and filament support wire 40 are mounted into the stacked and aligned beads 38 and 42. This subassembly is sealed in a vacuum furnace (not shown). In the sealing process the two beads 38 and 42 become fused to one another. The filament support wire 40 of this embodiment does not need to be made of a metal (such as DUMET® alloy) that has good sealing capability to glass, because a vacuum-tight seal of the support wire 40 within the first glass bead 38 is not necessary. In this embodiment, vacuum-tight sealing of the lamp's interior is accomplished by the fusion of the second bead 42 to the envelope 22. Therefore, the filament support 40 of this second embodiment 36 is preferably made of molybdenum alloy wire of the type normally used in state-of-the-art for filament support.

As is known in the art, manufacturing a glass bead having an axial hole or aperture that does not extend through the entire body of the bead, in other words the manufacture of a glass bead with a blind hole, is somewhat cumbersome and therefore relatively costly. The two-bead construction of the base of the second preferred embodiment 36, however, avoids the need for a glass bead having a blind hole, and nevertheless provides the principal advantageous features of the present invention, namely good vacuum-tight sealing of the lamp and solid anchoring of the filament support in the base of the lamp.

Figure 8:
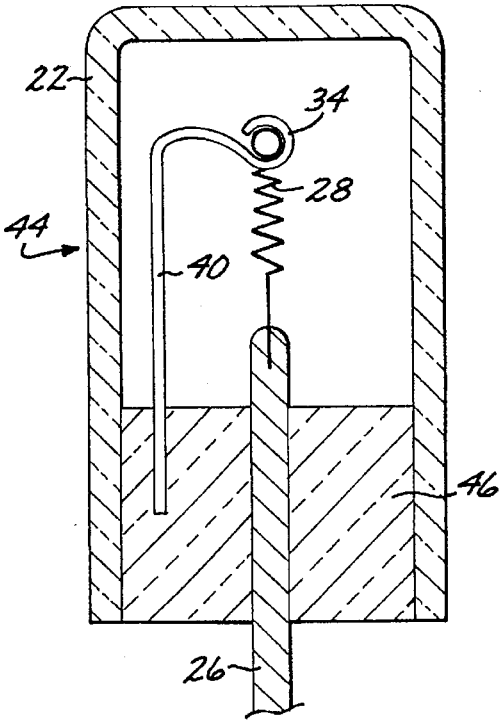
FIG. 8 is a cross-sectional view of a third preferred embodiment of the subminiature incandescent lamp of the present invention.

FIG. 8 discloses a third preferred embodiment 44 of the incandescent lamp of the present invention. In this embodiment 44 the base of the lamp consists of a single glass bead 46, into which the DUMET® alloy contact wires or pins 26 are mounted and sealed, as in the previously described embodiments. The glass bead base 46 also includes a filament support wire 40, which, however, is mounted into a blind hole that penetrates only a portion of the length of the base 46. In this embodiment 44, just like in the second preferred embodiment 36, the filament support wire 40 does not need to be sealed into the glass bead 46 in a vacuum-tight manner, and therefore it is preferably made from molybdenum alloy wire, rather than DUMET® wire.

What has been described above is a subminiature incandescent lamp having a support wire subassembly which is solidly anchored in the base of the lamp. All seals of the lamp are of substantially cylindrical configuration and provide excellent protection for maintaining vacuum inside the lamp. Several modifications of the present invention may become readily apparent to those skilled in the art in light of the foregoing disclosure. Therefore, the scope of the present invention should be interpreted solely from the following claims, as such claims are read in light of the disclosure.

What is claimed:

1. A subminiature incandescent lamp assembly comprising:

a glass base of substantially cylindrical configuration, the glass base having an aperture therein;

a glass envelope sealed to the glass base with a gas-tight glass-to-glass seal, and enclosing the interior of the lamp;

a pair of contact pins made of a metal alloy that has substantially same thermal expansion coefficient as the glass base, the contact pins being sealed in the glass base with a gas-tight glass-to-metal seal, the contact pins externally extending from the base to provide electrical contact with a power source for the lamp assembly and extending into the interior of the lamp;

a filament disposed between the contact pins in the interior of the lamp and in electrical contact with the pins, and a filament support wire in mechanical contact with the filament and mechanically supporting the same, the filament support wire being anchored in the aperture of the glass base.

2. A subminiature incandescent lamp assembly in accordance with claim 1 wherein the contact pins are made of a nickel iron alloy covered by a copper sheath.

3. A subminiature incandescent lamp assembly in accordance with claim 1 wherein the filament support wire is made of a metal alloy that has substantially same thermal expansion coefficient as the glass base.

4. A subminiature incandescent lamp assembly in accordance with claim 3 wherein the filament support wire is sealed in the glass base with a gas-tight seal and where the filament support wire extends through the entire length of the glass base.

5. A subminiature incandescent lamp assembly in accordance with claim 1 wherein the filament support wire is anchored in the glass base in the aperture that extends only partially through the glass base.

6. A subminiature incandescent lamp assembly in accordance with claim 5 wherein the filament support is made of molybdenum alloy wire.

7. A subminiature incandescent lamp assembly in accordance with claim 1 wherein the glass base comprises two glass beads stacked one on the other and fused to each other, the first one of said glass beads abutting the interior of the lamp and having the aperture, and wherein the filament support wire is mounted in the aperture that extends through the length of the first glass bead.

8. A subminiature incandescent lamp assembly in accordance with claim 7 wherein the filament support is made of molybdenum alloy wire.

9. A subminiature incandescent lamp assembly comprising:

a glass base of substantially cylindrical configuration and having an aperture;

a glass envelope sealed to the glass base with a gas-tight glass-to-glass seal, and enclosing the interior of the lamp;

a pair of contact pins made of a metal alloy that has substantially same thermal expansion coefficient as the glass base, the contact pins being sealed in the glass base with a gas-tight glass-to-metal seal, the contact pins being disposed substantially parallel with one another substantially axially in the glass base, extending externally from the base to provide electrical contact with a power source for the lamp assembly and extending into the interior of the lamp;

a filament disposed between the contact pins in the interior of the lamp and in electrical contact with the pins, and a filament support wire in mechanical contact with the filament for mechanically supporting the same, the filament support wire being made of a metal alloy that has substantially same thermal expansion coefficient as the glass base, the filament support wire being sealed in the aperture of the glass base with a gas-tight glass-to-metal seal.

10. A subminiature incandescent lamp assembly in accordance with claim 9 wherein in the glass base the filament support wire is disposed substantially parallel with the contact pins, and wherein the filament support wire penetrates substantially through the entire length of the glass base.

11. A subminiature incandescent lamp assembly in accordance with claim 10 wherein the contact pins are made of a nickel iron alloy covered by a copper sheath.

12. A subminiature incandescent lamp assembly in accordance with claim 10 wherein the filament support wire is made of a nickel iron alloy covered by a copper sheath.

13. A subminiature incandescent lamp assembly in accordance with claim 10 wherein the contact pins and the filament support wire are made of a nickel iron alloy covered by a copper sheath.

14. A subminiature incandescent lamp assembly comprising:

a glass base of substantially cylindrical configuration having an aperture that is disposed axially in the glass base and ends without extending to the exterior on the bottom of the glass base;

a glass envelope sealed to the glass base with a gas-tight glass-to-glass seal, and enclosing the interior of the lamp;

a pair of contact pins made of a metal alloy that has substantially same thermal expansion coefficient as the glass base, the contact pins being sealed in the glass base with a gas-tight glass-to-metal seal, the contact pins being disposed substantially parallel with one another substantially axially in the glass base, extending externally from the base to provide electrical contact with a power source for the lamp assembly and extending into the interior of the lamp;

a filament disposed between the contact pins in the interior of the lamp and in electrical contact with the pins, and a filament support wire in mechanical contact with the filament for mechanically supporting the same, the filament support wire being anchored in the aperture of the glass base.

15. A subminiature incandescent lamp assembly in accordance with claim 14 wherein the glass base consists of a single glass bead.

16. A subminiature incandescent lamp assembly in accordance with claim 15 wherein the filament support is made of molybdenum alloy wire.

17. A subminiature incandescent lamp assembly in accordance with claim 16 wherein the aperture in the glass base is disposed substantially parallel with the contact pins.

18. A subminiature incandescent lamp assembly in accordance with claim 14 wherein the glass base comprises a first and a second glass beads, the first bead being disposed on top of the second bead, the first and second beads being fused to each other, the first bead abutting the interior of the lamp, and wherein the aperture in the glass base is extends through the length of the first glass bead and terminates above the second glass bead.

19. A subminiature incandescent lamp assembly in accordance with claim 18 wherein the filament support is made of molybdenum alloy wire.

20. A subminiature incandescent lamp assembly in accordance with claim 19 wherein the aperture in the first glass bead is disposed substantially parallel with the contact pins.

* * * * *

UNITED STATES PATENT AND TRADEMARK OFFICE

CERTIFICATE OF CORRECTION

PATENT NO. : 5,659,222

DATED : August 19, 997

INVENTOR(S) : Ragsdale et al.

It is certified that error appears in the above-indentified patent and that said Letters Patent is hereby corrected as shown below:

Column 4, lines 17-18, after "in", add --the--.

Column 4, line 28, after "by way", add --of--.

Column 8, line 25, after "base", delete "is".

UNITED STATES PATENT AND TRADEMARK OFFICE

CERTIFICATE OF CORRECTION

PATENT NO. : 5,659,222

DATED : August 19, 1997

INVENTOR(S) : Ragsdale et al.

It is certified that error appears in the above-indentified patent and that said Letters Patent is hereby corrected as shown below:

Column 5, line 60, after "claimed", add --is--.

Column 8, line 22, "beads" should be --bead--.

Signed and Sealed this

Sixteenth Day of December, 1997

Bruce Lehman

*Attest:*

BRUCE LEHMAN

*Attesting Officer*

*Commissioner of Patents and Trademarks*